US005313907A

United States Patent [19]

Hodges

[11] Patent Number: 5,313,907

[45] Date of Patent: * May 24, 1994

[54] EXTERNAL RAIL SYSTEM FOR BOAT

[76] Inventor: Christopher A. Hodges, 706 Greatplain Ave., Needham, Mass. 02192

[ * ] Notice: The portion of the term of this patent subsequent to Apr. 27, 2010 has been disclaimed.

[21] Appl. No.: 33,330

[22] Filed: Mar. 18, 1993

Related U.S. Application Data

[63] Continuation-in-part of Ser. No. 855,354, Mar. 13, 1992, Pat. No. 5,205,235.

[51] Int. Cl.[5] ..... B63B 1/32

[52] U.S. Cl. ..... 114/290; 114/219; 293/128

[58] Field of Search ..... 114/218, 219, 283, 288, 114/290, 98, 97; 293/128

[56] References Cited

U.S. PATENT DOCUMENTS

| | | | |
|---|---|---|---|
| 3,361,104 | 1/1968 | Glass | 114/290 |
| 3,687,502 | 8/1972 | Loew | 293/128 |
| 5,205,235 | 4/1993 | Hodges | 114/219 |

*Primary Examiner*—Jesus D. Sotelo
*Attorney, Agent, or Firm*—Paul J. Cook

[57] ABSTRACT

A system of elongated rails installed on the exterior hull surfaces of boats and projecting externally from the exterior hull surfaces of the boats, and having the functional attributes of: deflecting spray, reducing the tendencies of the bows to go under in choppy or turbulent seas, reducing heel and side-slipping while turning, contributing lift, acting as fenders to protect the hulls, providing accessible hand holds and foot steps, reducing the rocking motions of the boats and adding flotation to the boats. The rails are formed of a polymeric foam interior and a skin formed of a polymeric sheet or a fabric material.

19 Claims, 9 Drawing Sheets

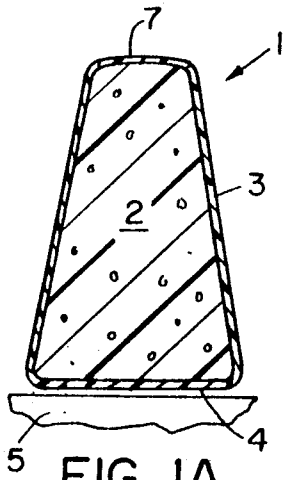
FIG. 1A
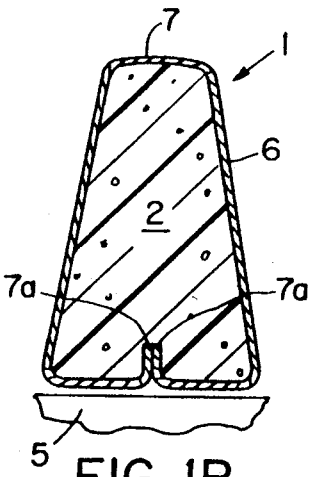
FIG. 1B
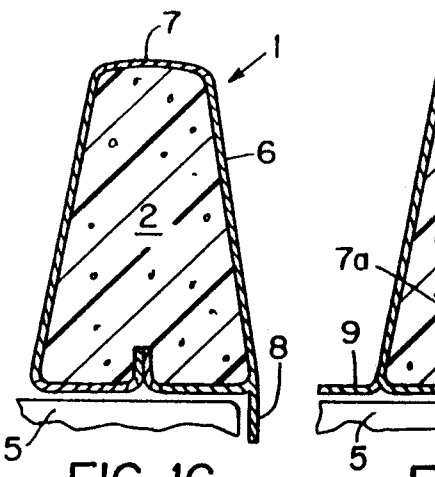
FIG. 1C
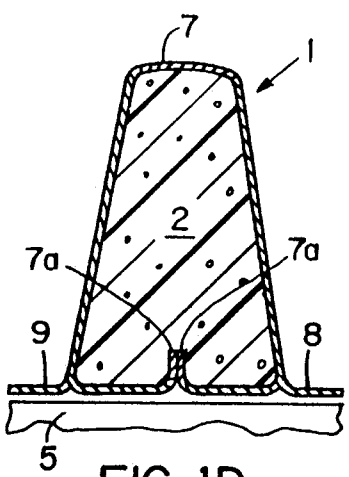
FIG. 1D
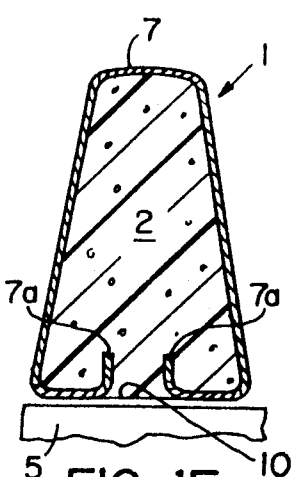
FIG. 1E
FIG. 2A
FIG. 2B
FIG. 2C
FIG. 2D
FIG. 2E

EXTERNAL RAIL SYSTEM FOR BOAT

REFERENCE TO RELATED APPLICATION

This application is a continuation-in-part application of application Ser. No. 855,354, filed Mar. 13, 1992, now U.S. Pat. No. 5,205,235.

BACKGROUND OF THE INVENTION

This invention relates to a rail structure and to an external rail system utilizing the rail structure affixed to the hull of a boat in order to control water spray and control direction of the boat during use of the boat. The problem in the art to which this invention apertains are the need for an external rail system for boats in which elongated rails are structurally affixed to the external surfaces of boat hulls and by which such rails collectively have, some and in some cases all, of the following functional attributes of deflecting spray; of reducing the tendency of the bow to go under in choppy or turbulent seas; of reducing heel and side-slipping while turning; of contributing lift to a fast-moving hull; of acting as a fender to protect the hull; of contributing a safety factor by providing an accessible hand hold or foot step for swimmers or a man overboard; of reducing the rocking motion of the boat while moored or anchored; and of adding flotation to the boat.

Prior to the present invention, it has been proposed by Glass, U.S. Pat. No. 3,361,104 to provide rails in the hull of a boat in order to reduce pounding of the boat during use. The rails are generally triangular in shape having a sharp point at the position of the rail most distant from the boat hull. The exposed unsupported surfaces are easily deformed through accidental contact during used. In addition, the sharp edge of the rail and its position is inefficient in deflecting spray away from the boat interior during use. Glass rails were not successful because of the bond failure between the resilient material and the base attachment.

It has been proposed in French Patent 762,452 of Derro to utilize an attachment fitted to the submerged section of a boat hull to provide a planing surface to effect a lifting force on a boat hull during use. The attachment includes a series of truncated triangles when viewed in cross-section. Since the attachment is submerged, and is on the bottom of the boat hull, it does not provide water spray control from the exposed hull surface during use of the boat.

It would be desirable to provide a boat rail and a boat rail system which can be easily and permanently attached to a boat hull, which is sufficiently strong to retain its shape during normal boat use and which can be positioned anywhere on a boat hull to provide spray control or control of the boat direction during use.

SUMMARY OF THE INVENTION

The present invention provides boat rails which can be permanently secured to any position in a boat hull and a boat rail system for controlling water spray and boat direction during use. The rails are formed of a shaped polymeric foam of suitable density to provide mechanical strength. The rail has a bottom surface which is covered with a fabric and adhered to a boat hull and additional surfaces including side surfaces and a top surface which are covered with a fabric material adhered thereto so that the remaining polymeric surfaces are not exposed. The bottom surface is adhered to the hull by interposing a fabric material between the hull and bottom surface. One or more flaps formed of the fabric material can also be provided which extend from an intersection between the bottom surface and either or both the side surfaces.

In the external rail system, the rails are discretely positioned and installed by structural bonding to the external surface of a boat hull. Collectively, the rails, as discretely positioned, and affixed, will have some if not all, of the following functional attributes, to wit: to deflect spray away from the boats; to reduce the tendency of the bows of the boats to move under the water surface while moving through choppy or turbulent seas; to reduce heel and side-slipping of the boats while turning; to contribute a degree of lift to the hulls of fast-moving boats; to act as fenders to protect the hulls of boats; to contribute a safety factor by providing accessible hand holds or foot steps for a person in the water, by which access to the boats can be gained; to reduce the rocking motions of boats while moored or anchored, brought about by the wakes from another moving boat; and to add additional floatation to the boats.

BRIEF DESCRIPTION OF THE DRAWINGS

FIG. 1 is a cross-sectional view of a rail of this invention utilizing a shrunk fit film covering FIG. 1*b* is a cross-sectional view of a rail of this invention utilizing a fabric covering.

FIG. 1*c* is a cross-sectional view of a rail of this invention utilizing a fabric covering having an additional flap.

FIG. 1*d* is a cross-sectional view of a rail of this invention utilizing a fabric covering having two additional flaps.

FIG. 1*e* is a cross-sectional view of a rail of this invention utilizing a fabric covering which extends a portion of the bottom base.

FIG. 2*a* through 2*e* is a cross-sectional view of an alternative rail of this invention including flaps.

Figure 4:
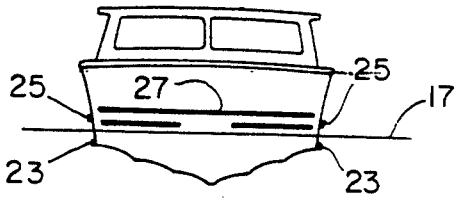
FIGS. 3–6 are front-elevational, starboard-side elevational and perspective views, respectively, of a boat having a displacement planing type or deep-v-hull.

Hereinafter, throughout the specification, "installed" will mean the discrete positioning and emplacement of an elongated rail on a hull surface, together with the structural bonding of such rail where it was discretely positioned and emplaced on the hull surface.

Depending upon the types of boats to be described, the specific hull locations at which are rails are installed, and the discrete ranges of PCF densities of the polymeric foam for the various rails that are utilized, such rails will have the functional attributes denoted by the following letter codes:

A to deflect spray away from the boat

B to reduce the tendency of the bow to go under while the boat is moving through choppy or turbulent seas C to reduce heel and side-slipping of the boat while turning D to contribute a degree of lift to the hull(s) of a fast moving boat E to act as a hull-protecting fender F to provide accessible hand holds or foot steps for a man or woman overboard, or a swimmer, whether or not in distress, by which access to the boat can be gained G to reduce the rocking motion of a boat H to add additional floatation to the boat The rails of this invention are formed from a shaped polymeric foam interior which is covered on all surfaces with a film or a non-woven or woven fabric. It is preferred to use a non-woven or woven fabric since the adhesive will penetrate the interstices in the fabric and form a stronger bond. It is most preferred to use a woven fabric since it provides the highest strength characteristics when the rail is in place. The interior can be formed of any polymeric composition so long as it has a density and mechanical strength to withstand normal forces during use while retaining its shape. Representative suitable foam polymeric compositions include polyethylene, polypropylene, polystyrene or the like. Polyethylene foam is preferred since it is mechanically strong and is available in a wide range of densities from about 1.7 pounds per cubic foot (PCF) to about 9.5 PCF. The greater the density of the polymeric foam, the greater the strength and structure rigidity imparted to the rail. The elongated rails, discretely positioned, emplaced and structurally affixed at various locations on the hull vary as to the discrete strength and rigidity required consistent with the functional attributes to be afforded. The top base surface of the rail of this invention must not end in a sharp point so that desirable control of water flow past the top base can be obtained to control splashing or boat direction. The top base should have a width of at least about between about 0.75 and 3 inches, side surfaces of between about 2 and 6 inches, preferably between about 2.5 and 4 inches and a bottom base of between about 2 and 5 inches, preferably between about 2 and 4 inches so that the rail in vertical cross section has a truncated shape. The top base can be flat or convex.

The woven or non-woven fabric which covers the shaped polymeric foam covers all of the top and side surfaces and at least the major por-tion of the bottom surfaces of the rail. The fabric covering can be bonded to the base or has two ends which are positioned within the shaped polymeric foam and are retained therein. The ends of the fabric covers are passed through the bottom base of the rail and are secured within the polymeric foam such as by friction or by embedding rod means along with the fabric ends. Retention of the ends within the foam interior provides improved stability of the fabric surface since the fabric can be enclosed tightly around the foam exterior. Representative suitable fabric coverings are formed from woven acrylic, polyester or polyamide (nylon) fibers or the like. The fabric covering on the bottom base and any exposed portion of the bottom base are secured to the hull of the boat by means of an adhesive tape and a epoxy or methacrylate based adhesive which provide sufficient strength of bonding to withstand normal forces encountered during use of the boat. When employing a film covering, it can be shrunk fit over the polymeric foam.

Referring to FIG. 1*a*, a rail of this invention 1 includes a polymeric foam interior 2 and a shrunk fit polymeric film covering 3. The top base 7 has a width to provide a truncated cross-section for the rail 1. Referring to FIG. 1*b*, the rail 1 includes a fabric covering 6 having ends **7*a* positioned within the polymeric foam 2 and extend through the bottom base 4. The bottom base 4 is adhered to a boat hull 5**. In FIG. 1*c*, like elements to that of FIG. 1*b* are shown by the same reference numerals. The rail 1 includes a fabric cover 6 having an additional flap 8 which can be attached to the fabric 6 such as by sewing or can be formed integrally of the fabric 6. The flap 8 provides additional surface area for adhering the rail 1 to the hull 5 of a boat thereby providing additional bond strength between the rail 1 and the hull 5.

Referring to FIG. 1*d*, the rail 1 is similar to that of FIG. 1*c* but includes an additional flap 9. Referring to FIG. 1*e*, the rail 1 is similar to that of FIG. 1*b* except the ends **7*a* are separated to form an open area portion 10 and expose the polymeric foam 2 directly to hull 5. Open area 10 forms no more than about/and preferably ⅓ of the area of bottom base 4. The rail 1 also can be provided with embedded rods 10*a* adjacent the fabric ends 7*a* to assist in retaining ends 7*a* within foam interior 2**.

Referring to FIG. 2*a*, the rail 11 includes a nonflat bottom surface 12 which can be positioned on a boat hull where two flat hull surfaces intersect. The rail 11 of FIG. 2*a* includes a shrunk polymeric film covering.

Referring to FIG. 2*b*, the rail 11 includes a fabric covering 13 having two ends 14 inserted within foam cover 2. Referring to FIG. 2*c*, the rail 11 includes a fabric flap 15. Referring to FIG. 2*d*, the rail 11 includes two fabric flaps 15 and 16. Referring to FIG. 2*e*, the rail 11 is positioned on a hull 13 with one flap 16 being adhered to a second hull surface.

Figure 5:
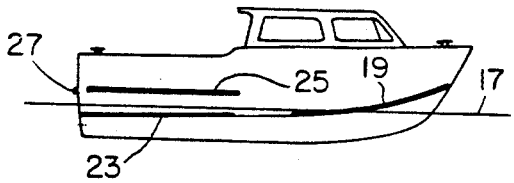
Figure 6:
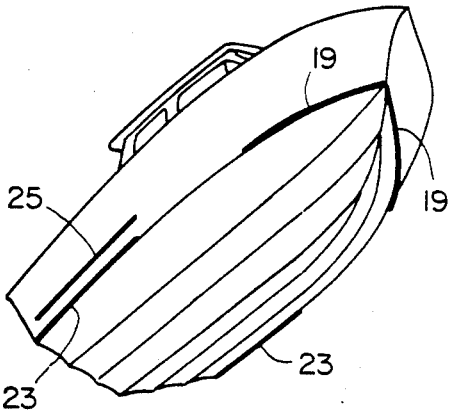
Figure 3:
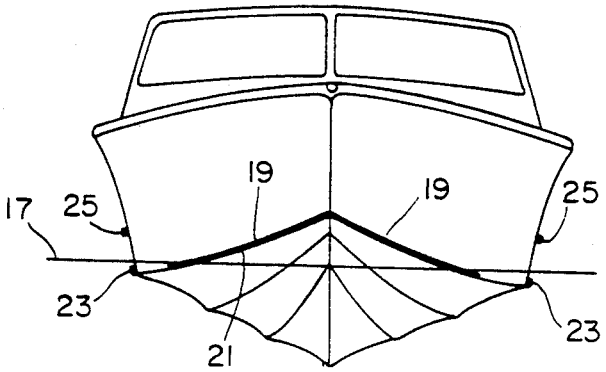

In FIGS. 3–6 which depict a boat having a displacement planning type or deep-v-hull. FIG. 3 is a front-elevational view. FIG. 4 is a rear-elevational view. FIG. 5 is a starboard-side elevational view and FIG. 6 is a perspective view. A port-side elevational view would be the same as FIG. 5. The waterline is indicated by reference numeral 17. The bow rails 19 are installed, as shown, (or sections of rail can be connected together) starting at the bow and running aft toward the stern sections with the bow rails 19 being positioned on the upper sides of or over the chine edges 21. The bow rails 19 can extend continuously from the bow to the stern of the boat. The densities of the bow rails range from 2.2 to 6.6 PCF and the bow rails 19 have the functional attributes A, B, D, E, F, and H. Rails 23 are similarly installed, on both the starboard and port sides, along the chine edges, starting from the stern and running toward the midship sections. The densities of the rails 23 range from 2.2 to 6.6 PCF and the rails 23 have the functional attributes A, C, D, E, F, G, and H. The fender rails 25 are similarly installed horizontally on both the starboard and port sides, 8" to 24" above the waterline 17, and their dimensional lengths approximate the dimensional lengths of the rails 23. The densities of the rails 25 range from 2.2 to 9.5 PCF and the rails 25 have the functional attributes E, F and H. The stern rail 27 is horizontally installed across the full width of the transom, 6" to 10" above the waterline 17. The stern rail 27 or rails 27B may provide clearance for swim-platform brackets, boarding ladders, etc. The stern rails 27 and 27B have a density ranging from 2.2 to 6.6 PDC and their functional attributes are A, E, F and H.

Figure 7:
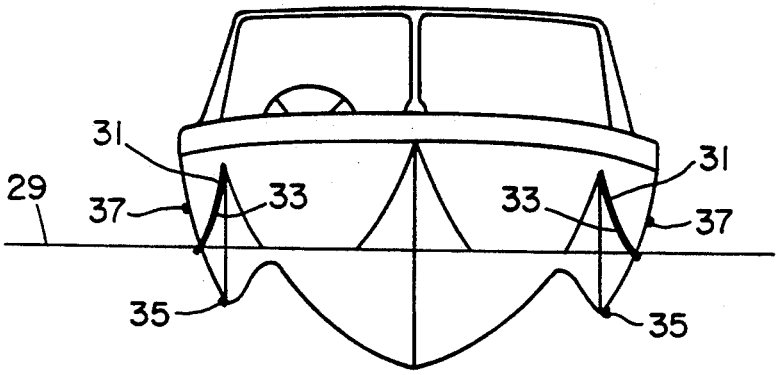
FIGS. 7–10 are front-elevational, port-side elevational and perspective views, respectively, of a boat having a cathedral planing type hull.
Figure 8:
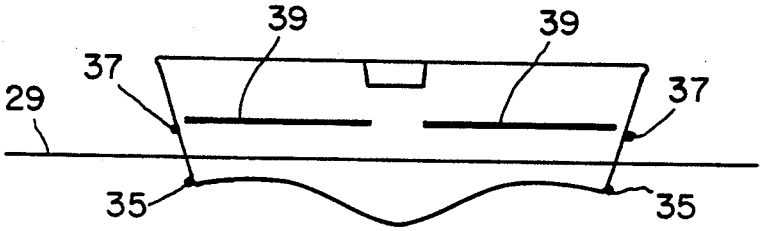
Figure 9:
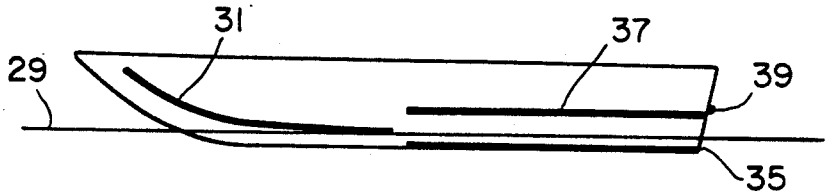
Figure 10:
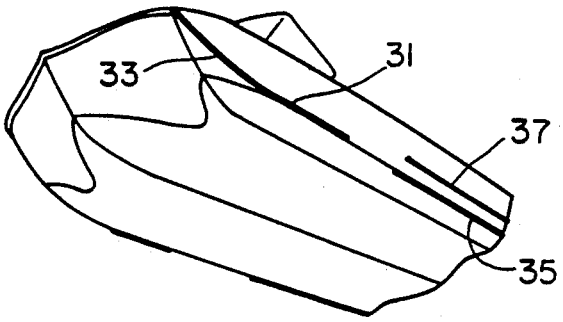

In FIGS. 7–10, which depict a boat having a cathedral planing type hull, FIG. 7 is a front-elevational view, FIG. 8 is a rear-elevational view of the hull. FIG. 9 is a port-side elevational view of the hull and FIG. 10 is a perspective view. A starboard-sideview would be the same as FIG. 9. The waterline 29 is indicated by reference numeral 29. The bow rails 31 are installed, as shown starting at the bow and running aft toward the stern sections, with the bow rails 31 being positioned on the upper sides of or over the chine edges 33. The bow rails 31 can run uninterruptedly from bow to stern. The bow rails 31 have densities ranging from 2.2 to 6.6 PCF and functional attributes A, B, D, E, F and H. Rails 35 are similarly installed, on both the port and starboard sides, on or above the chine edges, starting from the stern and running to the midship sections. The rails 35 have densities ranging from 2.2 to 6.6 PCF and functional attributes A, C, D, E, F, G and H. The fender rails 37 are similarly installed on both the port and starboard side, 8" to 24" above the waterline 29, and their dimensional lengths approximate the dimensional lengths of the rails 35. The rails 37 have densities ranging from 2.2 to 9.5 PCF and have functional attributes E, F and H. The stern rails 39, in two sections to provide space in the middle of the transom for an out-drive unit or outboard, are horizontally installed, otherwise, across the width of the transom, 6" to 10" above the waterline 29. The stern rails 39 range in their densities from 2.2 to 6.6 PCF and have functional attributes A, E, F and H.

Figure 11:
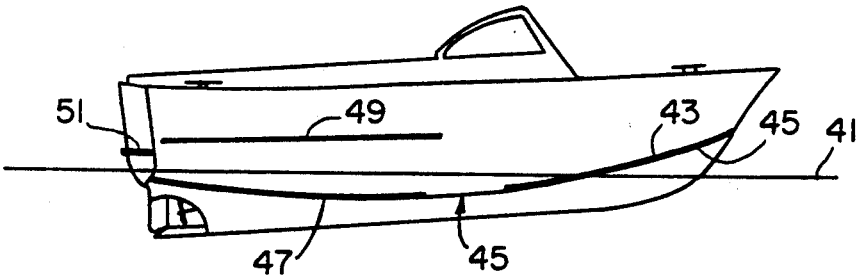
FIGS. 11–14 are starboard-side elevational, front-elevational, full-rear (and partial starboard side and partial bottom) perspective, and full port-side and full-bottom (and partial starboard-side) perspective views, respectively, of a typical flat bottomed runabout boat.
Figure 12:
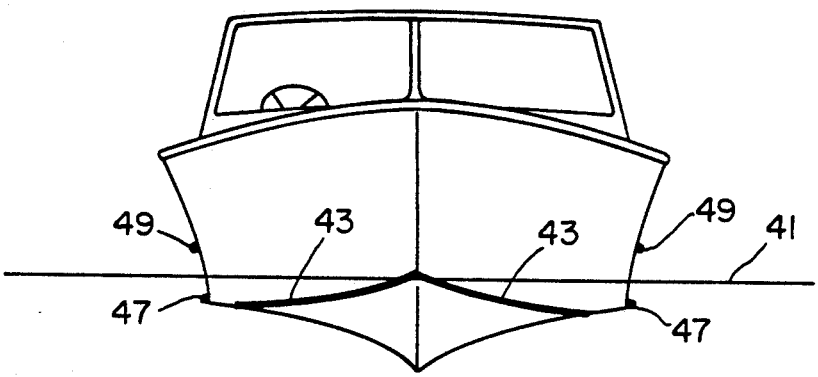
Figure 13:
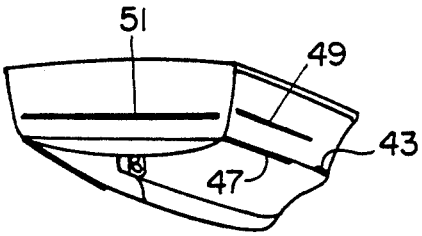
Figure 14:
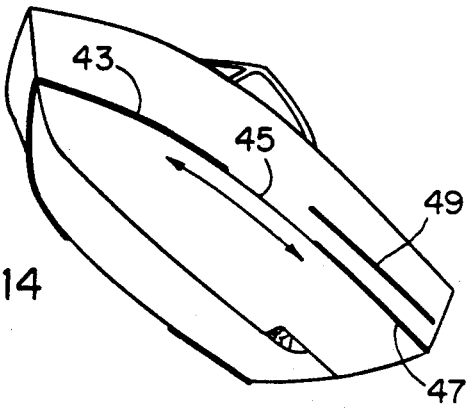

In FIGS. 11–14, which depict a typical flatbottomed runabout boat FIG. 11 is a starboard-side elevational view, FIG. 12 is a front-elevational view. FIG. 13 is a perspective view from the rear and FIG. 14 is a perspective view. The waterline is indicated by reference numeral 41. The bow rails 43 can run uninterruptedly, starting at the bow and running aft toward the stern sections, with the bow rails 43 being positioned on the upper sides or over the chine edges 45. The bow rails 43 have densities ranging from 2.2 to 6.6 PCF and functional attributes A, B, D, E, F and H. Rails 47 are similarly installed, on both the port and starboard sides, along the chine edges, starting from the stern and running to the midship sections. The rails have densities ranging from 2.2 to 6.6 PCF and functional attributes A, C, D, E, F, G and H. The fender rails 49 are similarly installed on both the port and starboard side, 8" to 24" above the waterline 41, and their dimensional lengths approximate the dimensional lengths of the rails 47. The fender rails have densities ranging from 2.2 to 9.5 PCF and have functional attributes E, F and H. The stern rail or rails 51, are horizontally installed, otherwise, across the full width of the transom, 6" to 10" above the waterline 41. The stern rail 51 can provide clearance for swim platform brackets, boarding ladders, etc. when installed as two or more sections. The stern rail 51 has its density ranging from 2.2 to 6.6 PCF and have functional attributes A, E, F and H.

Figure 15:
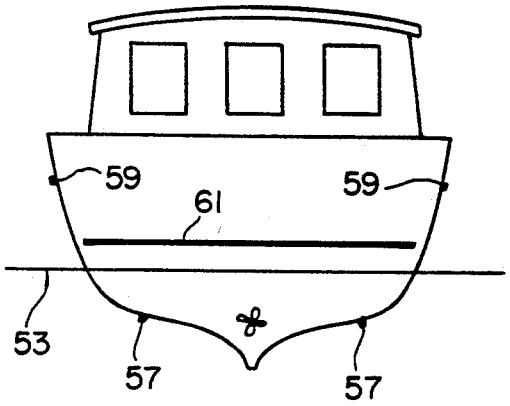
FIG. 15–18 are rear-elevational, front-elevational, starboard-side elevational and perspective views, respectively, of a round-bottomed cruiser-type boat.
Figure 16:
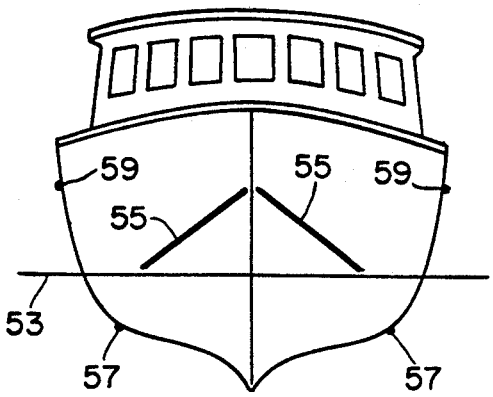
Figure 17:
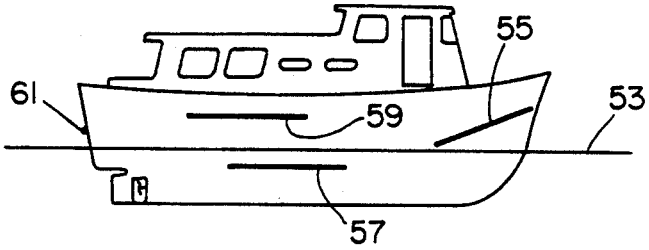
Figure 18:
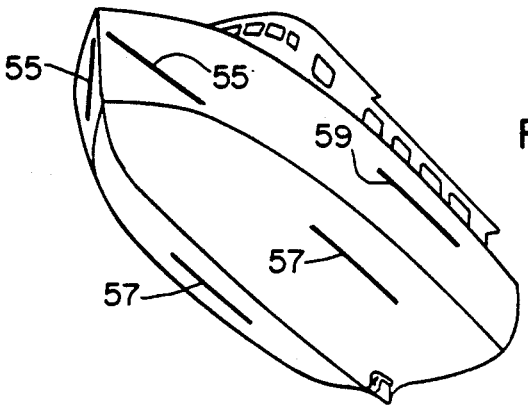

In FIGS. 15–18, which depict a round-bottomed cruiser-type boat FIG. 15 is a rear-elevational view, FIG. 16 is a front-elevational view. FIG. 17 is a starboardside elevational view and FIG. 18 is a perspective view. The waterline is indicated by reference numeral 53. For round-bottomed cruiser-type boats and sailboats whose hull lengths range from 28' to 40', the bow rails 55 are installed approximately 24" to 36" above the waterline 53, 2" back from the stem, running toward the waterline 53 at an acute angle of 0° to 30°. Assuming for purposes of trigonmetric construction, with reference to FIG. 17, that the waterline 53 defines a coincident imaginary rectilinear base line and assuming that a second imaginary rectilinear line, coincident with the bow rail 55, is extended to intersect such base line; accordingly, such second lines defines trigonmetrically with such base line, from the aspect of counterclockwise rotation, such (positive) acute angle of about 5° to 30°. With hull lengths of less than 28', the bow rails 55 would be installed approximately 12" to 24" above the waterline 53, about 2 inches back from the stem, running toward the waterline 53 at such acute angle of about 5° to 30°. The bow rails 55 have densities ranging from 2.2 to 6.6 PCF and functional attributes A, B, D, E, F and H. The bow rails 55 can extend continuously from bow to stern. Rails 57 are installed below the waterline 53, as shown, substantially amidships and approximately one-third of the distance from the waterline 53 to the keel. Rails 57 have densities ranging from 2.2 to 6.6 PCF and functional attributes F and H. The fender rails 59 are horizontally installed on both the starboard and port-sides, 8" to 24" above the waterline 53, running from the midship sections to the stern. The rails 59 have densities ranging from 2.2 to 9.5 PCF and functional attributes E, F and H. The stern rail or rails 61 are horizontally installed across the full width of the transom, 6" to 10" above the waterline 53. The stern rail or rails 61 provide clearance for swim-platform brackets, boarding ladders, etc. The stern rail has its density ranging from 2.2 to 6.6 PCF and functional attributes E, F and H.

Figure 19:
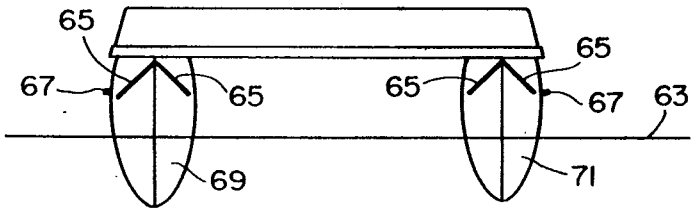
FIGS. 19–21 are front-elevational, starboard-side elevational and rear-elevational views, respectively, of a double-hulled (catamaran) power boat.
Figure 20:
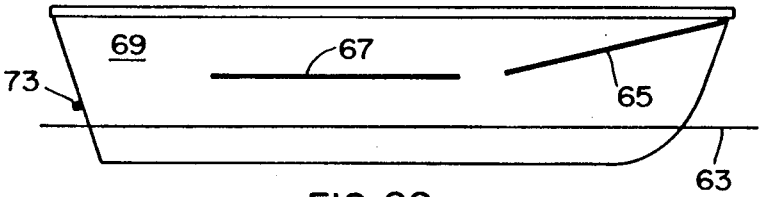
Figure 21:
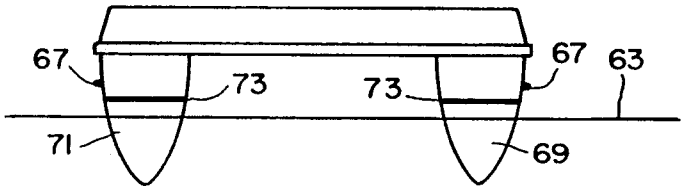

In FIGS. 19–21, which depict a double-hulled (catamaran) power boat FIG. 19 is a front-elevational view, FIG. 20 is a starboard-side elevational view and FIG. 21 is a rear elevational view. A port-side elevational view would be the same as FIG. 20. The waterline is indicated by reference numeral 63. The bow rails 65 are installed from the stem and run toward the waterline 63 at an acute angle ranging from 0° to 20° or can run continuously toward the stern. The bow rails 65 have densities ranging from 2.2 to 6.6 PCF and functional attributes A, B, D, E, F and H. The fender rails 67 are horizontally installed substantially amidships at a distance of 8" to 24" above the waterline 63, Only two fender rails 67 are installed: one fender rail 67 being installed on the starboard side of the starboard hull 69 and the second fender rail 67 being installed on the port side of the port hull 71. The fender rails 67 have densities ranging from 2.2 to 9.5 PCF and functional attributes E, F and H. One stern rail is horizontally installed across the full width of the transom of the port hull, 6" to 10" above the waterline 63 and the second stern rail 73 is horizontally installed across the full width of the transom of the starboard hull 69, 6" to 10" above the waterline 63. Either or both stern rails 73 may spatially provide clearance when necessary. The stern rails 73 have densities ranging from 2.2 to 6.6 PCF and functional attributes E, F and H.

Figure 22:
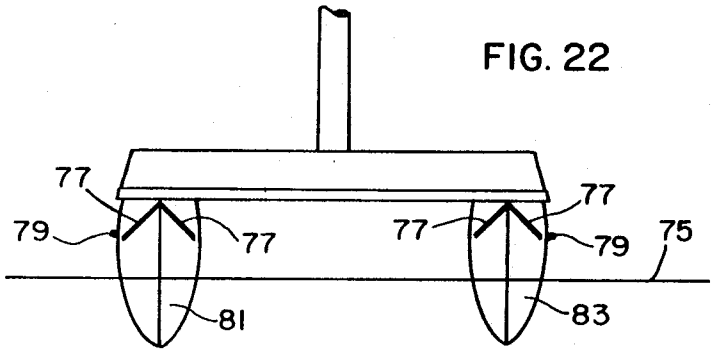
FIGS. 22–24 are front-elevational, starboard-side elevational and rear-elevational views, respectively, of a double-hulled (catamaran) sailboat.
Figure 23:
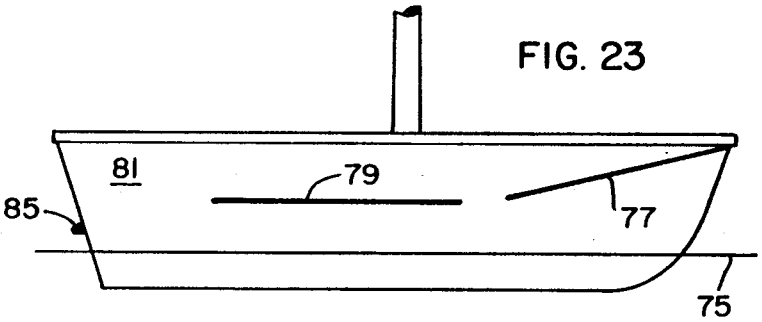
Figure 24:
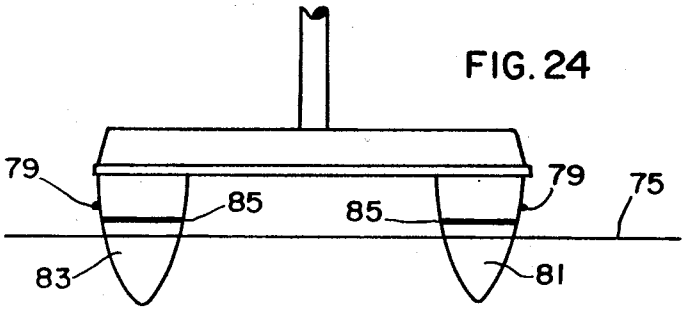

In FIGS. 22-24, which depict a double-hulled (catamaran) sail boat FIG. 22 is a front-elevational view, FIG. 23 is a starboard-side elevational view and FIG. 24 is a rear elevational view. A port-side elevational view would be the same as FIG. 23. The waterline is indicated by reference numeral 75. Reference numerals 81 and 83 are applied to the starboard hull and port hull, respectively. The bow rails 77, fender rails 79 and stern rails 85 are installed the same as respective bow rails 65, fender rails 79 and stern rails 73 and have been described with reference to FIGS. 19-21, and have the same respective densities and functional attributes.

Figure 25:
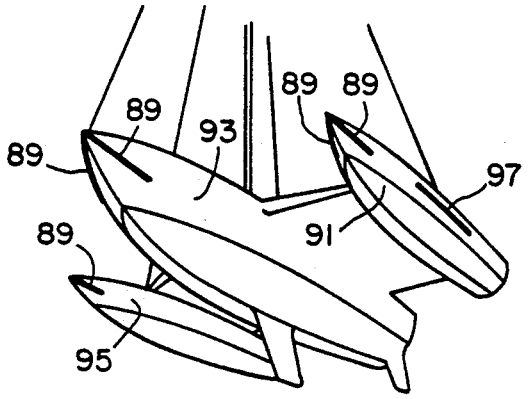
FIGS. 25–28 are perspective, front-elevational, port-side elevational and rear-elevational views, respectively, of a multihulled (trimaran) sailboat.
Figure 26:
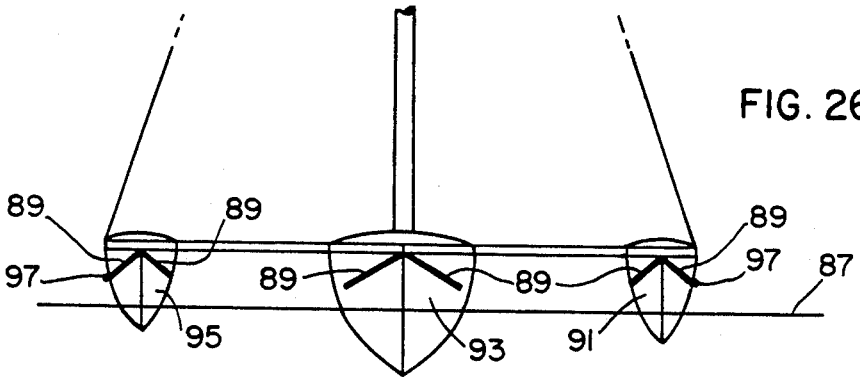
Figure 27:
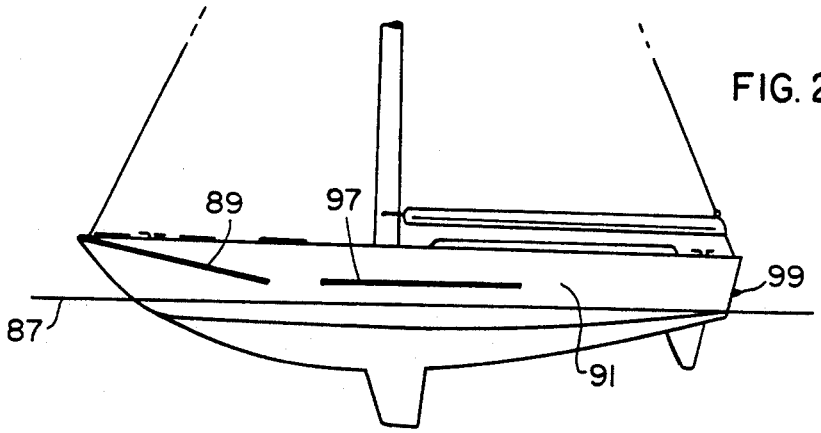
Figure 28:
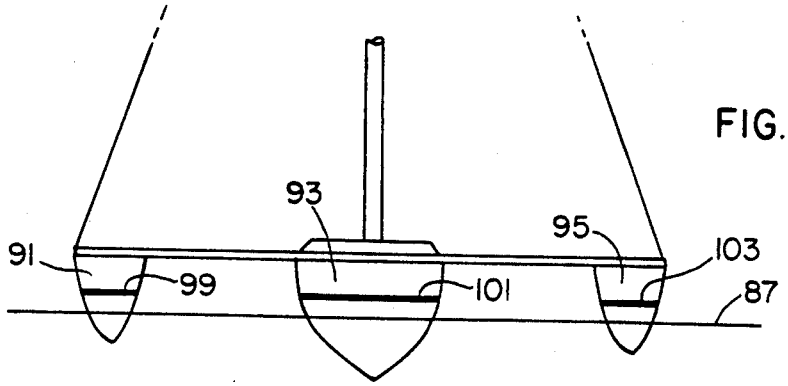

In FIGS. 25-28, which depict a multihulled (trimaran) sailboat FIG. 25 is a perspective view, FIG. 26 is a frontelevational view. FIG. 27 is a port-side elevational view and FIG. 28 is a rear elevational view. A starboard-side elevational view would be the same as FIG. 27. The waterline is indicated by reference numeral 87. The bow rails 89 are installed at the stems of each of the port, center and starboard hulls 91,.93 and 95 and run toward the waterline 87 at an acute angle of 0° to 20° or can run continuously toward the stern. The bow rails 89 have densities ranging from 2.2 to 6.6 PCF and functional attributes A, B, D, E, F and H. Only two fender rails 97 are horizontally installed amidships, 8" to 24" above the waterline 87, the one fender rail 97 being installed on the port side of the port hull 91 and the second fender rail being installed on the starboard side of the starboard hull 95. The fender rails 97 have densities ranging from 2.2 to 9.5 PCF and functional attributes E, F and H. One stern rail 99 is horizontally installed across the full width of the transom of the port hull 91, 6" to 10" above the waterline 87; a second stern rail 101 is horizontally installed across the full width of the transom of the center hull 93, 6" to 10" above the waterline 87; and the third stern rail 103 is horizontally installed across the full width of the transom of the starboard hull 95, 6" to 10" above the waterline 87. The stern rails 99, 101 and 103 have densities ranging from 2.2 to 6.6 PCF and functional attributes A, E, F and H.

Figure 29:
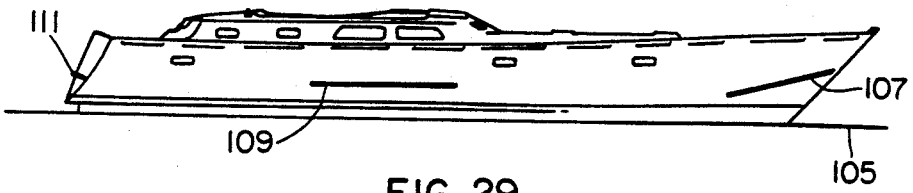
FIG. 29 is a starboard-side elevational view of a sailboat having a reverse transom.

FIG. 29 depicts a starboard-side elevational view of a sailboat having a reverse transom whose bottom edge is above the waterline, indicated by reference numeral 105. The sailboat is depicted with its mast removed. A port-side elevational view would be the same as FIG. 29. For hull lengths ranging from 28' to 40', the bow rails 107 are installed approximately 24" to 36" above the wasteline 105, 2" back from the stem and running toward the waterline or stern at an acute angle of 0° to 25°; for a hull length less than 28', the bow rails 107 are installed approximately 12" to 24" above the waterline 105, 2: back from the stem and running toward the waterline or stern at an acute angle of 0° to 25°. The bow rails 107 have densities ranging from 2.2 to 6.6 PCF and functional attributes A, B, D, E, F and H. All bow rails can run continuously from bow to stern. The fender rails 109 are horizontally installed on both the starboard and port sides, 8" to 36" above the waterline 105, running from amidships toward the stern. The fender rails 109 can also be run the entire length have densities ranging from 2.2 to 9.5 PCF and functional attributes E, F and H. The stern rail 111 is horizontally installed the full width of the reverse transom at a distance of / to / the distance up the reverse transom. The stern rail has densities ranging from 2.2 to 6.6 PCF and functional attributes A, E, F and H.

Figure 30:
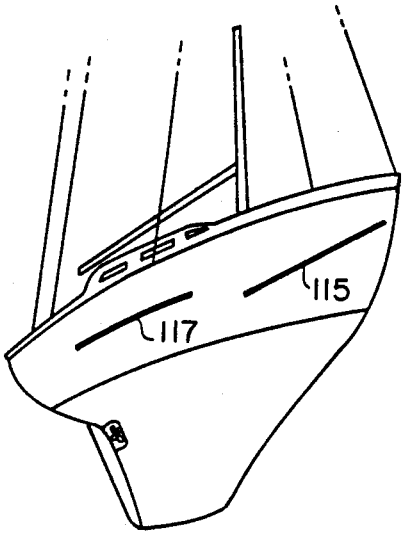
FIGS. 30–33 are perspective, front-elevational, rear-elevational and starboard-side views, respectively, of a displacement-type fixed-kneel sailboat.
Figure 31:
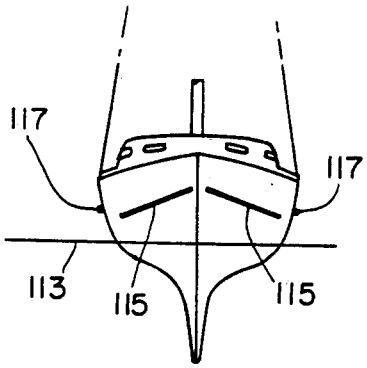
Figure 32:
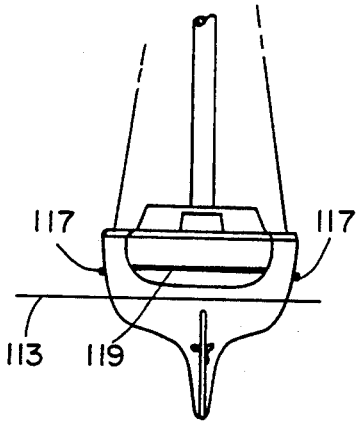
Figure 33:
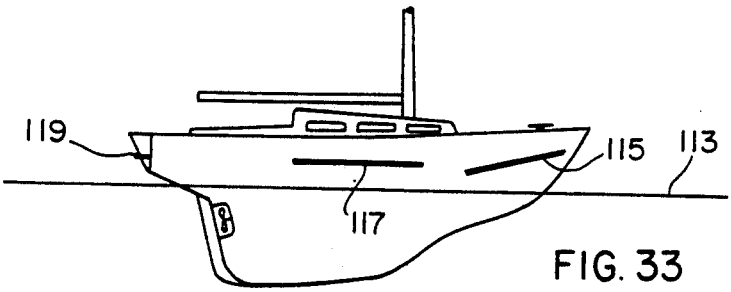

In FIGS. 30-33, which depict a round-bottom, fixed-keel sailboat FIG. 30 is a perspective view, FIG. 31 is a front-elevational view. FIG. 32 is a rear-elevational view and FIG. 32 is a starboard-side elevational view. A portside elevational view would be the same as FIG. 33. The waterline is indicated by reference numeral 113. For hull lengths ranging from 28' to 40', the bow rails 115 are installed 12" to 36" above the waterline 112, 2" back from the stem and running toward the waterline 113 or stern at an acute angle of 0° to 25°. The bow rails 115 have densities ranging from 2.2 to 6.6 PCF and functional attributes A, B, D, E, F and H. All bow rails can run continuously from bow to stern. As shown, the fender rails 117 are horizontally installed amidships on both the starboard and port sides, 8" to 40" above the waterline 113. The fender rails 117 have densities ranging from 2.2 to 9.5 PCF and functional attributes E, F and H. As shown, the stern rail 119 is horizontally installed across the full width of the raised transom at a level / to / the distance up the face of the raised transom. The density of the stern rail ranges from 2.2 to 6.6 PCF and functional attributes A, E, F and H.

FUNCTIONAL ATTRIBUTE A

The rails that have functional attribute A deflect spray. For example, the bow of a boat, plowing through water, causes water spray to be churned up and which churned-up spray flows over and upon the starboard and port sides and into the boat. All rails that have functional attribute A, especially the bow rails, function as physical barriers to intercept such water spray and deflect such water spray away from the boat.

FUNCTIONAL ATTRIBUTE B

When the bow of a boat plows through choppy or turbulent seas, the water impacts the bow with such force that the bow goes under. The bow rails have functional attribute B in that such choppy or turbulent water, upon impacting the bow-installed rails, continuously acts as a lifting force component against the bow rails to raise the bow of the boat and thereby reduces the prior tendency of the bow to go under.

FUNCTIONAL ATTRIBUTE C

When a boat makes a starboard turn, for example, the resulting and reactive centrifugal force, depending upon the speed of the boat, will cause the port side of the boat to rise above the water or heel and to skip or side-slip to its port side. The starboard-side rail, having functional attribute C, grabs or bites the water to act like a brake upon or within the water, with the result that heel and side-slipping are reduced.

FUNCTIONAL ATTRIBUTE D

When the bow of the boat is speeding through water, the plowed water will rise to impact the bow rails that have functional attribute D, with such water impacting against the bow rails and providing continuous impacting force components against the bow rails to contribute lift to the hull. Likewise, other rails, having functional attribute D, are continuously impacted against by the water, thereby providing force components which effect a degree of lift to the hull.

FUNCTIONAL ATTRIBUTE E

All rails, having functional attribute E, act as fenders to protect the hull from damage when such rails come into contact with a dock, pier, pilings, other boats or floating objects. With reference to FIGS. 15–18, it could be said that the hull would be protected against damage if rail 57, possessing functional attribute G, is struct by a submerged log, aligned with rail 57.

FUNCTIONAL ATTRIBUTE F

The rails that have functional attribute F contribute a safety factor by providing an accessible hand hold or foot step for a man or woman overboard, or a swimmer, whether or not in distress, by which access to the boat can be gained, or simply to hold onto such rail until help arrives for purposes of rescue.

FUNCTIONAL ATTRIBUTE G

Boats, moored or anchored, are subjected to rocking movements, principally from the wakes caused by other boats. Boats are afurther subjected to rocking movements from the natural effects of wind and waves. The rails of boats that have functional attribute G resist rocking by grabbing or biting into the water.

FUNCTIONAL ATTRIBUTE H

Rails in or upon the water provide floatation or buoyancy for the boat. Other rails that come into contact with the water when the boat begins to sink provide floatation or buoyancy to the boat. Thus, it can be said that all rails have functional attribute H, presently or prospectively.

Figure 34:
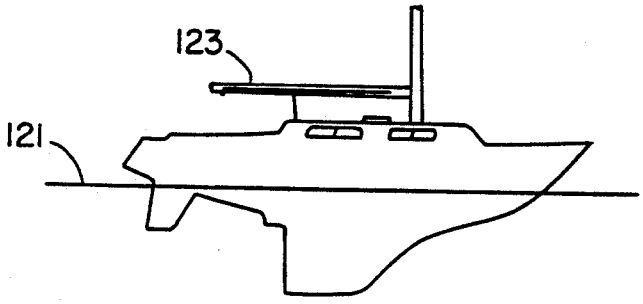
FIG. 34 is a starboard-side elevational view of a fixed-kneel sailboat.
Figure 35:
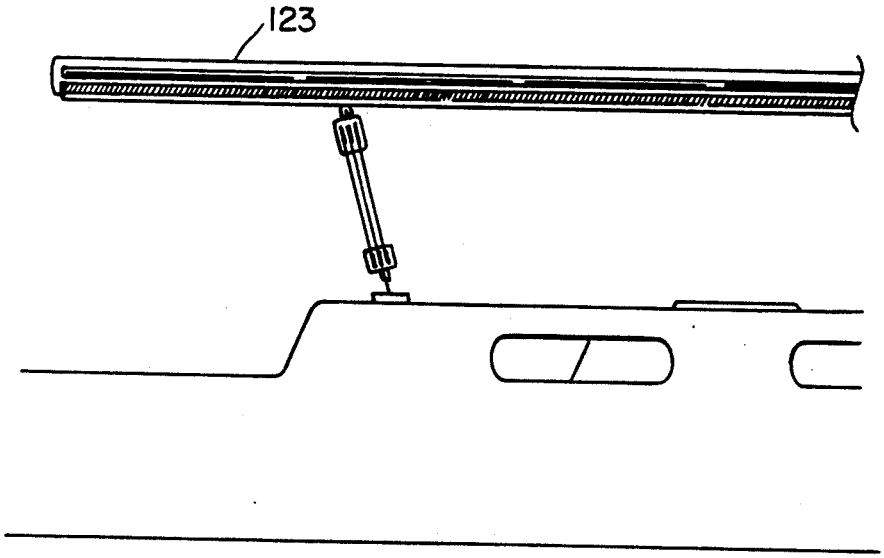
FIG. 35 is a partial blown-up view of the sailboat shown in FIG. 34.
Figure 36:
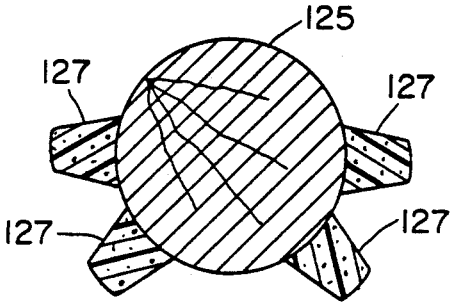
FIG. 36 is a cross-sectional view of a round-configured boom of a sailboat.
Figure 37:
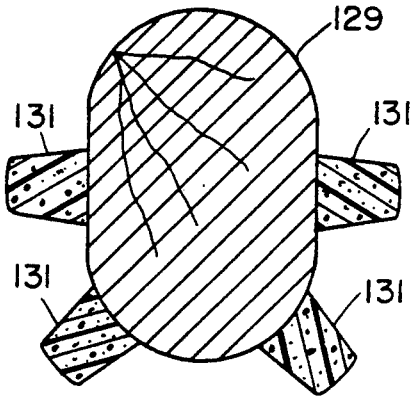
FIG. 37 is a cross-sectional view of a oval-configured boom of a sailboat.

In FIGS. 34 and 35, FIG. 34 is a starboard-side elevational view of a fixed-keel sailboat and FIG. 47 is a partial, blown-up view of the sailboat shown in FIG. 34. The waterline is indicated by reference numeral 121. The purposes of FIGS. 34 and 35 are to show the boom 123 in its environment for purposes of further description. On all types of sailboats, a swinging boom is a well-known cause of serious bodily injury, principally to the head of a person. A change in direction of the wind or a change in direction of the boat, while under sail, can cause violent movements of the boom, snapping like a whip from starboard to port and from port to starboard: when changing tack; while heading directly into the wind, with the sails and boom shaking violently; and, when running before the wind with the wind from astern, it is often difficult to maintain a straight course with the result that a "jibe" occurs, which causes the boom to snap violently from side to side. This problem occurs with all sailboats, without regard to whether the sailboat has a fixed keel or centerboard. FIG. 36 is a cross-sectional view of a round boom 125 having installed safety rails 127 at the approximate 3 o'clock, 4:30, 7:30 and 9 o'clock positions, with the oval boom 129 representing the face of an oval clock. The safety rails 127 and 131 are of the same type shown and described with reference to FIG. 1, with the polymeric foam, coated with the exterior skin of woven fabric. The material utilized for the safety rails 127 and 131 is the low density polymeric foam having respective densities of 1.7 PCF and 2.2 PCF to thereby provide a resiliant material where affixed to the boom which can reduce a person from sustaining serious injury when he or she is struck in the head by the safety rail unsuspectingly, when the boom whips across.

I claim:

1. An elongated rail for installation on an exterior surface of a boat, said rail having a cross-section comprising a bottom base, two side surfaces and a truncated top base wherein said top base joins said side surfaces, said rail having an exterior skin of material selected from the group consisting of a polymeric sheet and a fabric material covering said bottom base, said side surfaces and said top base, and enclosing an interior made of a polymeric foam material, said sheet or fabric in contact with said bottom base for adhesively and structurally bonding said rail to a portion of the exterior surface and said sheet or fabric having ends extending into said interior from said bottom base.

2. The rail of claim 1 including at least one second flap secured to said woven fabric material at the intersection between a side surface and said bottom base, said second flap for adhesively and structurally bonding said rail to a portion of the exterior hull surface.

3. The rail of claim 2 including rod means for securing said end flaps within said polymeric foam material.

4. The rail of claim 3 having a nonflat bottom base shaped to conform to a nonflat portion of a boat hull exterior surface.

5. The rail of claim 2 having a nonflat bottom base shaped to conform to a nonflat portion of a boat hull exterior surface.

6. A system for controlling water spray from an outside boat hull surface in contact with water which comprises the elongated rail of claim 2 bonded at the bottom base of said rail to said hull at a hull position wherein water spray is directed away from said hull by said rail.

7. The system of claim 6 wherein said rail is bonded to a non-flat surface of said hull.

8. A system for a boom on a sailboat for reducing injury which comprises at least one elongated rail of claim 2 bonded at the bottom base of said at least one rail to said boom.

9. The rail of claim 1 including two second flaps secured to said woven fabric material at the intersection between a side surface and said bottom base, said second flap for adhesively and structurally bonding said rail to a portion of the exterior hull surface.

10. The rail of claim 9 including rod means for securing said end flaps within said polymeric foam material.

11. The rail of claim 10 having a nonflat bottom base shaped to conform to a nonflat portion of a boat hull exterior surface.

12. The rail of claim 9 having a nonflat bottom base shaped to conform to a nonflat portion of a boat hull exterior surface.

13. A system for controlling water spray from an outside boat hull surface in contact with water which comprises the elongated rail of claim 9 bonded at the bottom base of said rail to said hull at a hull position wherein water spray is directed away from said hull by said rail.

14. The system of claim 13 wherein said rail is bonded to a non-flat surface of said hull.

15. A system for a boom on a sailboat for reducing injury which comprises at least one elongated rail of claim 9 bonded at the bottom base of said at least one rail to said boom.

16. The rail of claim 1 having a nonflat bottom base shaped to conform to a nonflat portion of a boat hull exterior surface.

17. A system for a boom on a sailboat for reducing injury which comprises at least one elongated rail of claim 1 bonded at the bottom base of said at least one rail to said boom.

18. A system for controlling water spray from an outside boat hull surface in contact with water which comprises the elongated rail of claim 1 bonded at the bottom base of said rail to said hull at a hull position wherein water spray is directed away from said hull by said rail.

19. The system of claim 18 wherein said rail is bonded to a non-flat surface of said hull.

* * * * *